US011678775B2

(12) United States Patent
Sperry et al.

(10) Patent No.: US 11,678,775 B2
(45) **Date of Patent: *Jun. 20, 2023**

(54) WIPE DISPENSING SYSTEM AND METHOD FOR PRODUCING DISINFECTANT WIPES ON DEMAND

(71) Applicant: HyResults, LLC, Redwood City, CA (US)

(72) Inventors: Charles R. Sperry, Chester, CT (US); Vincent A. Piucci, Jr., Oakham, MA (US); Dennis F. McNamara, Jr., Walpole, NH (US); Lawrence Pillote, Naperville, IL (US); Jose Antonio Ramirez, Vernon Hills, IL (US); Grayson Martin, Redwood City, CA (US)

(73) Assignee: HyResults, LLC, Redwood City, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/519,933

(22) Filed: Nov. 5, 2021

(65) Prior Publication Data

US 2022/0053983 A1 Feb. 24, 2022

Related U.S. Application Data

(63) Continuation of application No. 16/406,564, filed on May 8, 2019, now Pat. No. 11,191,397.

(60) Provisional application No. 62/669,023, filed on May 9, 2018.

(51) Int. Cl.
*A47K 10/22* (2006.01)

(52) U.S. Cl.
CPC ..... *A47K 10/22* (2013.01)

(58) Field of Classification Search
CPC ..... A47K 10/22
USPC ..... 700/231–244
See application file for complete search history.

(56) References Cited

U.S. PATENT DOCUMENTS

| | | | | |
|---|---|---|---|---|
| 6,213,424 | B1 * | 4/2001 | Helfer-Grand | A47K 10/34 242/563 |
| 8,833,691 | B1 * | 9/2014 | Zosimadis | A47K 10/3662 242/563.2 |
| 10,238,245 | B2 * | 3/2019 | Rubenson | A47K 10/32 |
| 10,835,087 | B2 * | 11/2020 | Duarte | A47K 10/44 |
| 11,000,163 | B2 * | 5/2021 | Shanahan | A47K 10/3687 |
| 11,191,397 | B2 * | 12/2021 | Sperry | A47K 10/22 |
| 2013/0213995 | A1 * | 8/2013 | Horel | A47K 10/424 221/197 |

(Continued)

*Primary Examiner* — Michael Collins
(74) *Attorney, Agent, or Firm* — Duquette Law Group

(57) ABSTRACT

Embodiments of the innovation relate to a wipe dispensing system that includes a wipe supply, a drive assembly disposed in operational communication with the wipe supply, a fluid dispensing assembly, and a wipe dispensing controller disposed in electrical communication with the drive assembly and the fluid dispensing assembly. The wipe dispensing controller is configured to receive a wipe criterion which defines a characteristic of a wipe to be provided by the wipe dispensing system, dispose a portion of the wipe supply between a first position and a second position relative to the fluid dispensing assembly via the drive assembly and based upon the wipe criterion, and apply a fluid to the portion of the wipe supply via the fluid dispensing assembly based upon the wipe criterion to generate the wipe.

19 Claims, 4 Drawing Sheets

(56) References Cited

U.S. PATENT DOCUMENTS

| | | | | |
|---|---|---|---|---|
| 2017/0042390 | A1* | 2/2017 | Rubenson | A47K 10/32 |
| 2018/0242577 | A1* | 8/2018 | Tsai | H05H 1/2406 |
| 2019/0147375 | A1* | 5/2019 | Ghazi | A47K 10/3625 700/236 |

* cited by examiner

WIPE DISPENSING SYSTEM AND METHOD FOR PRODUCING DISINFECTANT WIPES ON DEMAND

RELATED APPLICATIONS

This patent application claims the benefit of U.S. application Ser. No. 16/406,564, filed on May 8, 2019, entitled "Wipe Dispensing System and Method for Producing Disinfectant Wipes on Demand" which claims the benefit of U.S. Provisional Application No. 62/669,023, filed on May 9, 2018, entitled, "Method of Producing Disinfectant Wipes on Demand," the contents and teachings of each of which are hereby incorporated by reference in their entirety.

BACKGROUND

Each year in the United States alone, 1.7 million patients contract a nosocomial, or hospital-acquired infection (HAI). Ninety-nine thousand people die annually as a result of these infections, making this the fourth leading cause of death in the United States. The direct medical impact of HAIs on the healthcare system is estimated at $35-$45 billion. It is estimated that the combined direct and indirect costs; i.e. impact on humanity, is $96-$147 billion. Since 80% of infectious diseases are transmitted by touch, adequate cleaning of high-touch surfaces within healthcare facilities by healthcare workers can dramatically decrease the spread of infection.

Disinfecting surfaces within health care environments presents a significant challenge. This challenge becomes even more daunting as new, stronger and increasingly resistant pathogens emerge. In response, manufacturers strive to develop fast-acting, easy-to-apply disinfectants that kill a variety of bacteria and viruses and reduce the risk of cross-contamination. As new challenges arise, development of new cleaning formulas and methods continues. Cleaning products for health care environments must be formulated to balance efficacy and surface compatibility.

Efficiency and ease of use are important qualities for cleaning products. In today's hospital settings, for example, cleaning staff may have as little as 20 minutes to clean and disinfect a patient room between the discharge of one patient and admission of the next. Effectiveness, speed and safety of cleaning and disinfecting products and methods are critical to the elimination of pathogens on surfaces and reduction of the risk of spreading infection. Numerous high-touch surfaces within a patient room and bathroom should be disinfected with each patient discharge. Examples of these surfaces include:

| Patient Room |
|---|
| Headboard |
| Bed rails |
| Nurse call button and cord |
| TV remote |
| Handrails |
| Bedframe |
| Footboard |
| Nightstand |
| Over-the-bed table |
| Mirrors |
| Computers |
| Telephones |
| Arm chairs |
| Cabinet handles |
| Door knobs |

-continued

| |
|---|
| Light switches |
| Patient equipment |
| Blood pressure cuff and tubing |
| Infusion poles |
| IV pump control |
| Multi-module monitor controls, touch screen, cables |
| Ventilator control panel |
| Bathroom |
| Sink counter, faucet and handles, basin, under the sink, soap dispenser |
| Grab bars |
| Shower fixtures |
| Shower floor |
| Toilet bowl, seat, exterior and handle |
| Light switches |
| Door knob and plate |

Not only are there a multitude of surfaces that need to be disinfected, there are many types of surfaces, some of which are not compatible with all disinfectants. Not all surfaces can be cleaned in the same manner. To effectively disinfect all surfaces, multiple chemicals and processes are necessary.

Over the past ten years, the use of pre-moistened, disposable disinfecting wipes has become common practice in healthcare environments. These wipes have advantages over traditional cleaning methods. A pre-saturated, ready-to-use wipe eliminates the need to apply disinfectant to a towel, or to the surface to be cleaned. This ensures uniform delivery of the disinfectant to the treated surface, and eliminates overspray of disinfectant onto nearby surfaces that may be incompatible with the disinfectant being used.

Pre-packaged wipes are available with a variety of chemistries that target specific pathogen groups and are compatible for use on various surfaces. For example, conventional disinfecting chemicals that are utilized include sodium hypochlorite (bleach), hydrogen peroxide, quaternary ammonium compounds (quat), isopropyl and other alcohols. Wipes are available in different sizes as well as different packaging types and quantities.

SUMMARY

Although an improvement over prior cleaning methods, pre-packaged wipes suffer from a variety of disadvantages and deficiencies. For example, cleaning protocols may require multiple types of wipes to assure surface compatibility (i.e., disinfectant chemistry does not attack and compromise the surface being cleaned) as well as efficacy of the chemistry to kill the targeted pathogens. In another example, pre-packaged wipes can be more costly than other cleaning products, largely due to processing and packaging cost. Further, wipes must be manually removed from their packaging containers. This means that the containers are handled to remove each wipe, providing a great opportunity for the container to become contaminated. As the cleaning staff touches a contaminated surface and then touches the wipes container to remove a wipe, pathogens can be transferred to the container, and then, through the hands, from the container to other surfaces. Lastly, there is no accountability of wipe usage or ability to track usage. This can result in the use of an incorrect wipe for a particular application, as well as increased waste, etc.

In view of the above, it can be seen that there is a need in the healthcare industry for an improved method of supplying moistened disinfectant wipes that is more cost effective, versatile, easy to use, and reduces the spread of contaminants.

By contrast to conventional cleaning methods, embodiments of the present innovation includes a wipe dispensing system and a method for producing disinfectant wipes on demand, such as at the point of use within a healthcare environment. In one arrangement, the system includes a wipe dispensing controller that, when prompted, moistens a wipe with a cleaning and/or disinfecting solution and provides the wipe to an end user. The moistened wipe can then be used by a healthcare facility's cleaning, nursing or other staff for the purpose of cleaning and disinfecting surfaces within the facility.

These disinfectant wipes provide a number of advantages over conventional wipes, such as pre-packaged wipes. Examples of these advantages are provided as follows.

Lower cost per wipe: the manufacturing costs incurred with presoaking and packaging wet wipes is mitigated. With the embodiments of the current innovation, wipes are prepared by the automatic dispenser at the point of use with little to no increased labor or manufacturing costs.

Minimization of packaging: the dry wipe and disinfectant is supplied in bulk with minimal packaging. This mitigates the costly packaging of presoaked wipe containers. It also minimizes the amount of waste generated by this packaging.

Flexibility of wipe material: multiple wipe substrate materials can be utilized by embodiments of the current innovation. These can include non-woven materials, microfiber, paper, etc., and can vary in thickness and other attributes. In some embodiments, the wipe may be non-transmissive, i.e., only one side is wet with a barrier to keep the user's hand dry.

Flexibility of wipe size: the length of wipe can be selectable by the user. This minimizes waste and allows for versatility in cleaning. In some embodiments, the width of the wipe is also selectable.

Flexibility of disinfectant chemistry: the type of disinfectant used to wet the wipe can be selectable for the specific application or pathogen being targeted. Chemicals can range from basic cleaning detergents to disinfectants such as sodium hypochlorite, quat, or alcohol, for example.

Selective wetting of wipe: with the current innovation, the amount and location of liquid dispensed onto the wipe is controllable. Wipes can be produced that range from slightly damp to fully saturated and are selectable by the user for a specific use. Likewise, the location of the liquid can be selected, for example, only on one side of the wipe so that it has a wet side to clean and a dry side to dry.

Minimization of cross-contamination: unlike pre-packaged wipes in containers that must be handled by the user and are subject to contamination, embodiments of the present innovation minimizes human contact, thus minimizing the risk of cross-contamination. For example, pre-moistened wipes are supplied in a tub, pouch or other container that the user must handle in order to retrieve a wipe. The container may become contaminated with pathogens from the user's hands or a surface onto which the container is placed. These pathogens can be transferred to other locations, users or patients as the wipe container is moved from place to place during use. In the present innovation, the wipe is prepared and delivered to the hand of the user without the need for the user to touch the dispenser to retrieve it. Other embodiments of the innovation may include a touch-free interface to further reduce this risk. For example, this can be accomplished with the use of a non-contact user interface, for example, a voice activated control or a remote control.

Connectivity and accountability: the wipe dispensing system of the current innovation contains intelligent electronics, such as a controller having a processor and memory, configured to perform multiple functions. For example, the controller can control the output of the dispenser (i.e., wipe material and length as well as type), control the quantity and location of disinfectant, operate the user interface, and proactively monitor system functionality. In one embodiment, the controller can provide wireless monitoring of product consumption and in-house inventory management and control, as well as real time data on unit usage by individual, unit, and other metrics. The wipe dispensing system can also supply usage and other statistics for use in management or billing, for example, and enables a "Pay per Use" services model.

While the wipe dispensing system is described for use in a healthcare facility, it is not limited to that use, as it can be used in any facility where cleaning and disinfecting is important, such as in restaurants or hotels, for example.

Additionally, the wipe dispensing system is not limited to the cleaning of surfaces, as it can be extended to human use. For example, a wipe can be moistened with a hand sanitizer for the cleaning of hands. Wipes can be formulated for use in a nursery as baby wipes. A therapeutic solution or other treatment can be applied and used for the treatment of patients as wound dressings or for other medicinal treatments.

In one arrangement, embodiments of the innovation relate to a wipe dispensing system that includes a wipe supply; a drive assembly disposed in operational communication with the wipe supply; a fluid dispensing assembly; and a wipe dispensing controller disposed in electrical communication with the drive assembly and the fluid dispensing assembly. The wipe dispensing controller is configured to receive a wipe criterion which defines a characteristic of a wipe to be provided by the wipe dispensing system, dispose a portion of the wipe supply between a first position and a second position relative to the fluid dispensing assembly via the drive assembly and based upon the wipe criterion, and apply a fluid to the portion of the wipe supply via the fluid dispensing assembly based upon the wipe criterion to generate the wipe.

In one arrangement, embodiments of the innovation relate to in a wipe dispensing controller, a method for dispensing a custom wipe from a wipe dispensing system. The method includes receiving a wipe criterion which defines a characteristic of the custom wipe to be provided by the wipe dispensing system; disposing a portion of a wipe supply between a first position and a second position relative to a fluid dispensing assembly via the drive assembly and based upon the wipe criterion; and applying a fluid to the portion of the wipe supply via the fluid dispensing assembly based upon the wipe criterion to generate the custom wipe.

In one arrangement, embodiments of the innovation relate to a wipe dispensing controller, having a processor and a memory. The wipe dispensing controller is configured to receive a wipe criterion which defines a characteristic of a wipe to be provided by a wipe dispensing system; dispose a portion of a wipe supply between a first position and a second position relative to a fluid dispensing assembly via a drive assembly and based upon the wipe criterion; and apply a fluid to the portion of the wipe supply via a fluid dispensing assembly based upon the wipe criterion to generate the wipe.

BRIEF DESCRIPTION OF THE DRAWINGS

The foregoing and other objects, features and advantages will be apparent from the following description of particular embodiments of the innovation, as illustrated in the accompanying drawings in which like reference characters refer to the same parts throughout the different views. The drawings are not necessarily to scale, emphasis instead being placed upon illustrating the principles of various embodiments of the innovation.

DETAILED DESCRIPTION

Embodiments of the present innovation includes a wipe dispensing system and a method for producing disinfectant wipes on demand, such as at the point of use within a healthcare environment. In one arrangement, the system includes a wipe dispensing controller that, when prompted, moistens a wipe with a cleaning and/or disinfecting solution and provides the wipe to an end user. The moistened wipe can then be used by a healthcare facility's cleaning, nursing or other staff for the purpose of cleaning and disinfecting surfaces within the facility.

Figure 1:
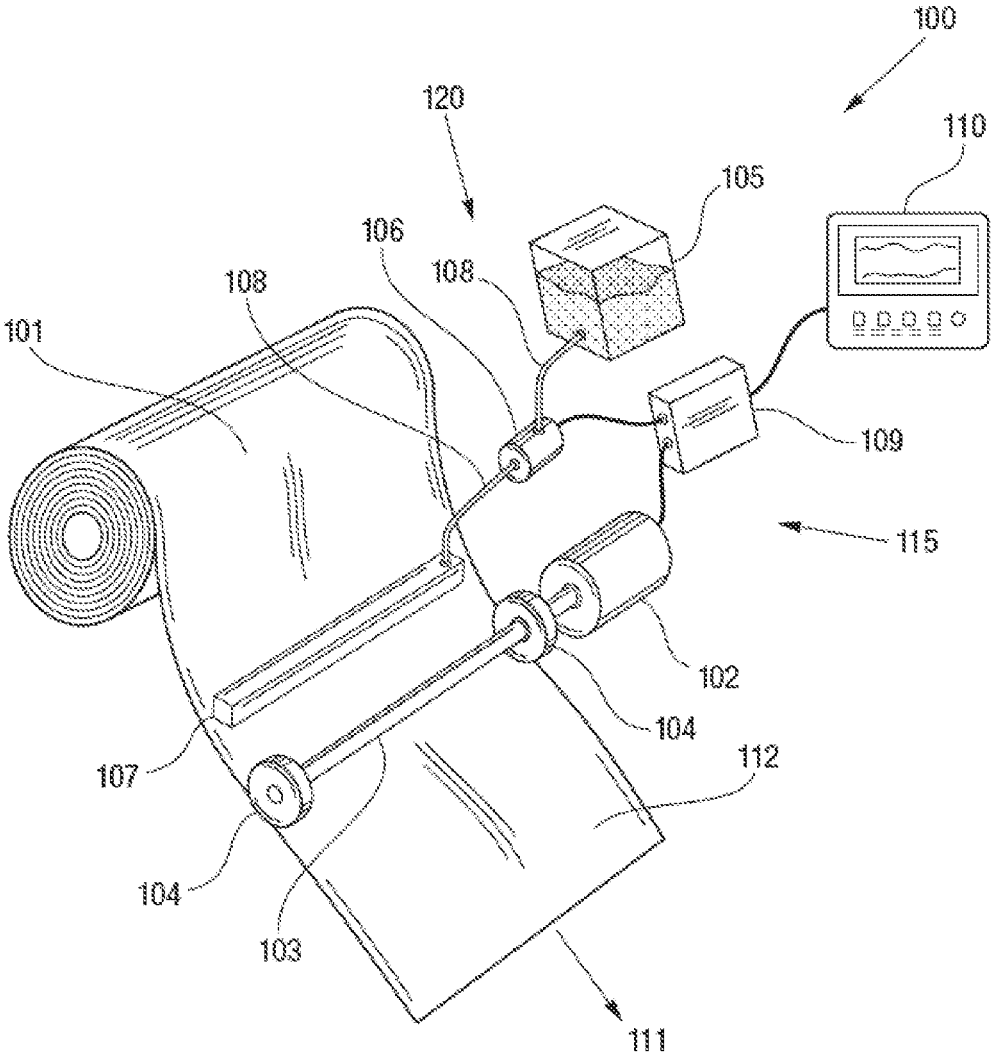
FIG. 1 illustrates schematic representation of a wipe dispensing system, according to one embodiment.

FIG. 1 shows a generally schematic view of a wipe dispensing system 100 according to one embodiment. The wipe dispensing system 100 includes a wipe supply 101, a drive assembly 115, a fluid dispensing assembly 120, and a wipe dispensing controller 109 disposed in electrical communication with the drive assembly 115 and the fluid dispensing assembly 120.

The wipe supply 101 provides the source of material 116 utilized by the wipe dispensing system 100 when creating a wipe 112. For example, in one arrangement, the wipe supply 101 is a continuous roll of material. Further, while a single wipe supply 101 is illustrated, the wipe dispensing system 100 can include multiple wipe supplies 101. In one arrangement, each wipe supply 101 can include a different wipe material. For example, the wipe dispensing system 100 can include a first wipe supply which includes a roll of paper material and a second wipe supply that includes a roll of cloth material.

The wipe supply 101 can be supplied in various forms. One form is that of a continuous roll of material, as depicted in FIG. 1. Commercially available wipes are commonly 6 to 12 inches on a side, although both larger and smaller wipes are seen. The width of the roll can be chosen for the desired width of the wipe 112. The wipe material 116 may be pre-perforated at predetermined lengths so that when it is wetted and dispensed, the user can tear the wipe 112 from the supply. For example, there can be longitudinal perforations every 6 inches. If the width of the roll is, for example, 8 inches wide, the delivered wipe 112 will be 6 by 8 inches. If a larger wipe is desired, solution can be dispensed across perforations, creating a wipe 112 that is 12 by 8 inches, 18 by 8 inches, etc.

In one embodiment, the wipe supply 101 can be provided as individual sheets of wipe material 116. These sheets may be stacked or interlocked in a manner in which each sheet that is removed pulls the next one into a dispensing position relative to the dispensing assembly 120. The descriptions included here are only examples of possible supply formats. Other arrangements are anticipated by this innovation.

The wipe supply 101 can include a variety of types of materials 116. For example, the wipe supply 101 can include nonwoven fabric, which is a conventional wipe material used for disinfectant wipes. Nonwoven wipes are made from materials such as polypropylene and polyester. These materials are generally rugged and absorbent. In another example, the wipe supply 101 can include microfiber materials for use as disinfectant wipes. Microfiber cloth can be either woven or non-woven and is generally produced from polyester. Compared to other nonwoven materials, microfiber is relatively softer and more absorbent due to its fiber structure.

In another example, the wipe supply 101 can include cotton materials, which, however, are relatively less absorbent than nonwoven materials and microfiber. In another example, the wipe supply 101 can include a non-transmissive wipe material. This is a multi-layer material that has an absorbent side and a non-absorbent, or barrier side. Solution is dispensed onto the absorbent side. The non-absorbent side remains dry and prevents the user's hands from becoming wet with solution.

Because the wipes 112 are wet at the time of use, the wipe supply 101 can utilize materials 116 that are not practical for use with pre-moistened wipes, such as paper and other pulp products. Accordingly, the wipe dispensing system 100 allows the use of a wide selection of wipe materials 116, and the selection can be based on economic, environmental, performance and compatibility factors.

The drive assembly 115 is disposed in operational communication with the wipe supply 101 and is configured to adjust the wipe supply 101 to position a portion 114 of the wipe material 116 relative to the fluid dispensing assembly 120. In one arrangement, the drive assembly 115 can include a drive motor 102 that drives a drive shaft 103 having drive rollers 104 disposed in contact with the material 116 of the wipe supply 101. During operation, the drive assembly 115 can advance the wipe supply 101 and wipe material 116, such as along direction 111 or can retract the wipe supply 101 and wipe material 116, such as along direction 113.

The fluid dispensing assembly 120 is configured to deliver a fluid or solution to a portion 114 of the wipe material 116 from the wipe supply 101. In one arrangement, the dispensing assembly 120 includes a supply or reservoir 105 of cleaning and/or disinfect solution (hereinafter referred to as solution), a pump 106, a dispensing head 107, and fluid connectors, such as connecting supply tubes 108.

The fluid dispensing assembly 120 can utilize any desired cleaning and/or disinfecting solution. Solutions typically used as disinfecting cleaners include sodium hypochlorite (bleach), hydrogen peroxide, quaternary ammonium compounds (quat), isopropyl and other alcohols. The wipe dispensing system 100 can utilize any of these solutions, along with others, including solutions such as detergent-based and other cleaners, polishes, and/or other treatments. As new solutions or preparations are developed, they can be used with the wipe dispensing system 100.

Solutions can be dispensed by a variety of methods. FIG. 1 depicts an example of the fluid dispensing assembly 120 that includes the solution reservoir 105 supplying solution to the pump 106 via a connector 108-1. The pump 106 is configured to pressurize the solution and deliver the pressurized fluid into the dispenser head 107 via connector 108-2. As an example, the dispenser head 107 may be configured as a hollow elongated bar or structure defining an array of holes (not shown) on the underside through which the solution can pass and be dispensed onto the portion 114 of the wipe material 116.

Figure 2:
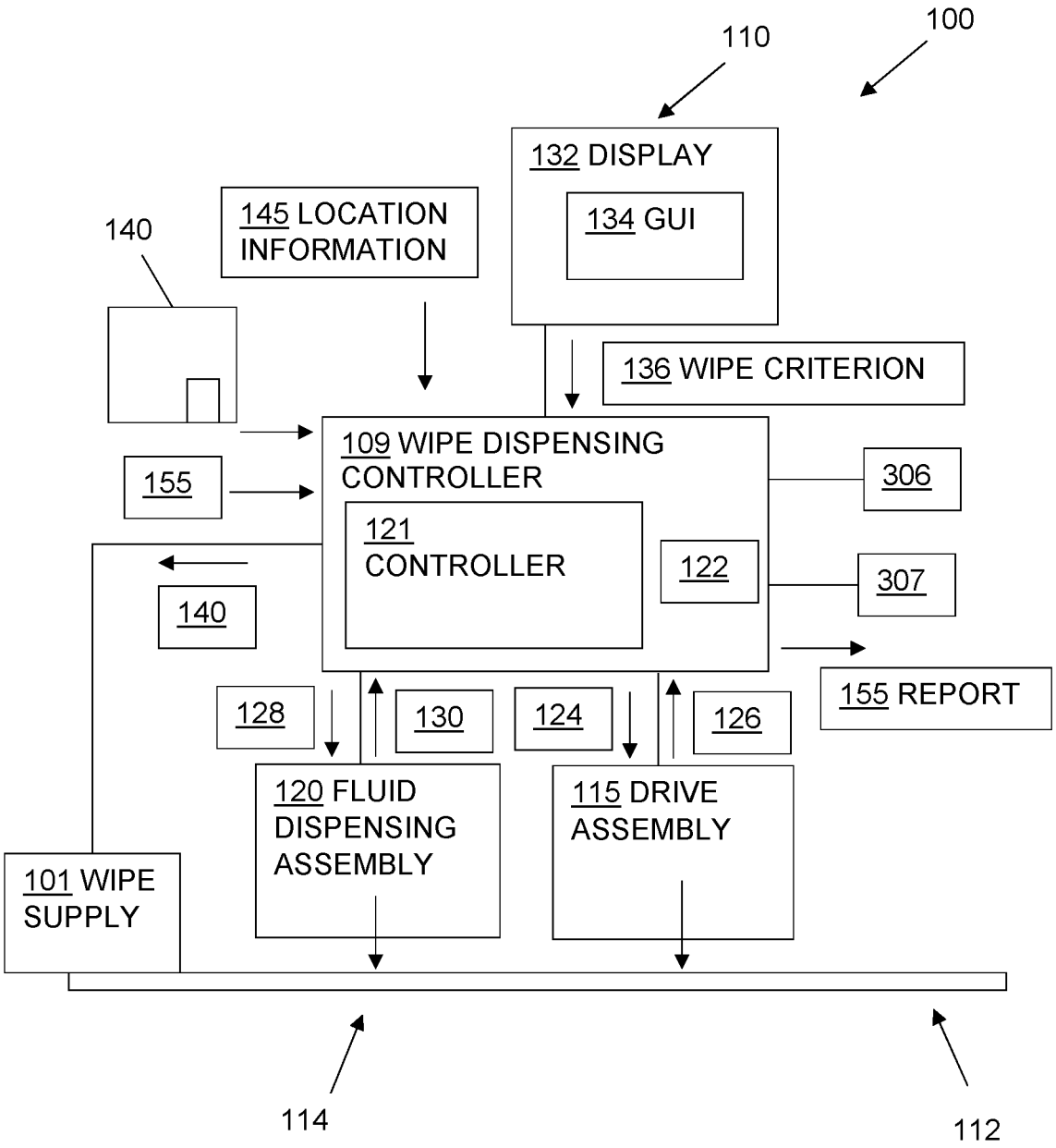
FIG. 2 illustrates a schematic representation of a wipe dispensing controller of the wipe dispensing system of FIG. 1, according to one embodiment.

With additional reference to FIG. 2, the wipe dispensing controller 109 is disposed in electrical communication with the drive assembly 115 and the fluid dispensing assembly 120. As illustrated, the wipe dispensing controller 109 can include a controller 121, such as having a processor and memory, in the form of a custom circuit board, PLC controller, embedded computer or other control device.

Further, the wipe dispensing controller 109 can include a power supply 122 to supply power to operate the wipe dispensing system 100. For example, in the case where the wipe dispensing system 100 is configured as a portable device, the power supply 122 can be a battery. However, in the case where the wipe dispensing system 100 is configured as a stationary device, such as a wall mounted device, or in the case where the wipe dispensing system 100 includes a back-up to the battery power, the power supply 122 can be an AC line voltage connection.

The wipe dispensing controller 109 is configured to manage and maintain operation, statistical and usage information, and communication functions of the wipe dispensing system 100. For example, the wipe dispensing controller 109 connects to and controls the drive motor 102 of the drive assembly 115, the pump 106 of the fluid dispensing assembly 120, as well as any other devices, sensors 307, and/or external communications that may be included as part of the wipe dispensing system 100.

In one arrangement, the wipe dispensing controller 109 is configured to operate the drive assembly 115, such as by transmitting an operation signal 124 to the drive assembly 115 to control the speed and direction of the drive motor 102. To recognize the speed of travel and/or length of the wipe 112, the wipe dispensing controller 109 can receive a feedback signal 126 from the drive assembly 102 or from devices associated with the drive assembly 102, such as stepper motors, motors with encoders, limit switches, or other sensors. The wipe dispensing controller 109 can be further configured to handle auxiliary functions related to the drive assembly 120, such as severing the wipe, material selection, handling the wipe supply 101, or measuring the remaining amount of wipe material on the wipe supply 101, for example.

In one arrangement, the wipe dispensing controller 109 is configured to operate the fluid dispensing assembly 120 such as by transmitting an operation signal 128 to the dispensing assembly 120 to dispense the solution. For example, transmission of the operation signal 128 can select and pump the solution, actuate any devices that are used to selectively place the solution, and or heat the solution in the reservoir 105. In one arrangement, wipe dispensing controller 109 is configured to receive a feedback signal 130 from the fluid dispensing assembly 120 to the monitor an aspect of the fluid dispensing assembly 120, such as the quantity of solution remaining in the reservoir 105.

Also as illustrated, the wipe dispensing controller 109 is disposed in electrical communication with a user interface 110 which allows a user to operate the wipe dispensing system 100. For example, during operation, a user can interact with the user interface 110 to generate and transmit a wipe criterion 136 to the wipe dispensing controller 109. As will be described in detail below, the wipe criterion 136 defines a characteristic of a wipe to be provided by the wipe dispensing system 100. For example, the wipe criterion 136 can identify the type of wipe desired by the user and can define multiple modes of interaction between the wipe dispensing controller 109 and the remaining elements of the system 100.

In one embodiment, the user interface 110 can include one or more pushbuttons that are pre-programmed to dispense a predetermined wipe or can include discreet buttons to select one or more wipe products. In the embodiment shown in FIG. 2, the user interface 110 can include a display 132 which provides a graphical user interface (GUI) 134 to present information to the user. For example, the user interface 110 can include a touch screen or a remote operation through a smartphone, tablet, or a dedicated remote controller. In some embodiments, the user interface 110 may include voice recognition system, such as a multi-lingual voice recognition system, to mitigate or eliminate the need to touch the device at all during a cleaning operation.

The controller 121 of the wipe dispensing controller 109 can store an application for the wipe dispensing system 100. For example, a wipe dispensing application installs on the controller 121 from a computer program product 140. In some arrangements, the computer program product 140 is available in a standard off-the-shelf form such as a shrink wrap package (e.g., CD-ROMs, diskettes, tapes, etc.). In other arrangements, the computer program product 140 is available in a different form, such downloadable online media. When performed on the controller 121 of the wipe dispensing controller 109, the wipe dispensing application causes the wipe dispensing controller 109 to perform a wipe dispensing process as well as data analysis.

Figure 3:
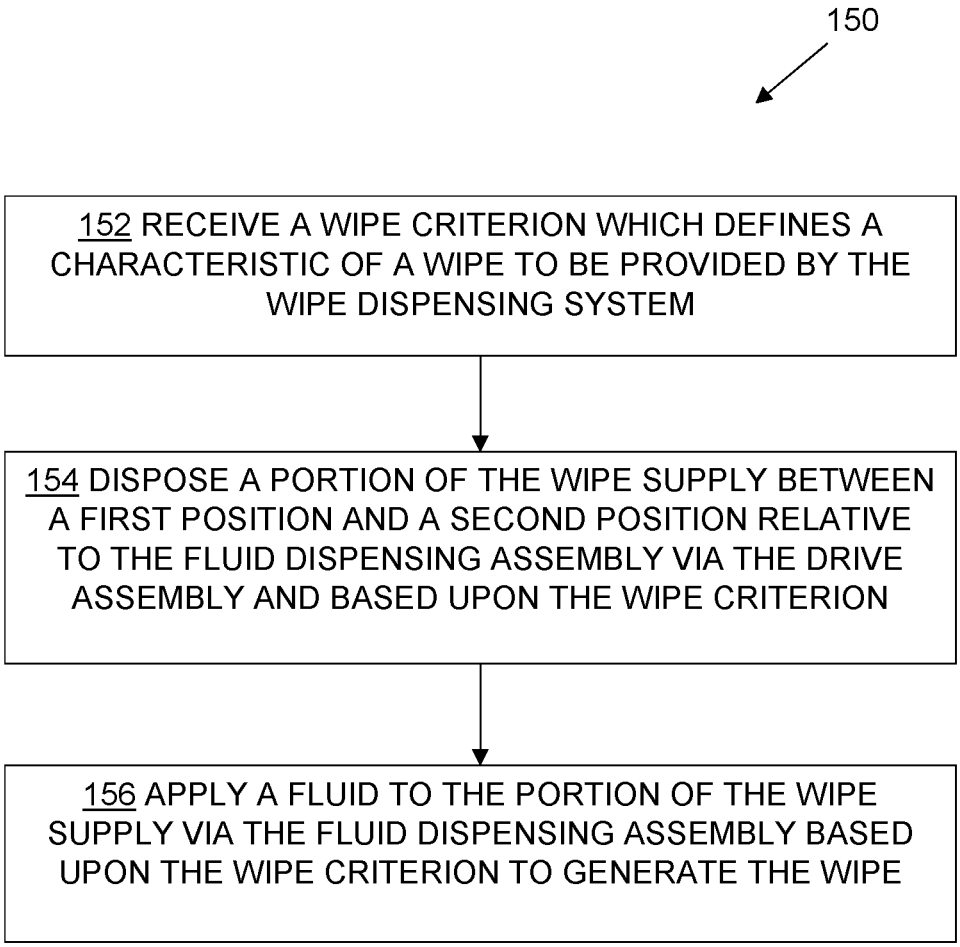
FIG. 3 is a flowchart which outlines an example operation of the wipe dispensing controller, according to one arrangement.

As provided above, the wipe dispensing system 100 is configured to produce a disinfectant wipe on demand, such as at the point of use within a healthcare environment. FIG. 3 is a flowchart 150 which outlines an example operation of the wipe dispensing controller 109 during a wipe producing and dispensing process.

In step 152, the wipe dispensing controller 109 receives a wipe criterion 136 which defines a characteristic of a wipe 112 to be provided by the wipe dispensing system 100. In one arrangement, the wipe dispensing controller 109 can receive the wipe criterion 136 via the user interface 110. For example a user, who may be cleaning staff or a nurse for example, can access the user interface 110 and can select or identify a particular type of wipe 112 for use, such as via the GUI 134. In response to receiving the selection, the user interface 110 generates and transmits the wipe criterion 136 to the wipe dispensing controller 109. Alternately, the wipe dispensing controller 109 can utilize other mechanisms (e.g., sensors, memory) to receive user-selected commands, preset criteria, location information, or other identifiers to initiate wipe production.

In step 154, the wipe dispensing controller 109 disposes a portion 114 of the wipe supply 101 between a first position and a second position relative to the fluid dispensing assembly 120 via the drive assembly 115 and based upon the wipe criterion 136. For example, the wipe criterion 136 can identify a particular wipe material 116 to be used to generate the wipe. In such a case, the wipe dispensing controller 109 can select a corresponding wipe supply 101 and can activate the drive assembly 115 via operation signal 124 to drive the wipe material 116 forward along direction 111 from its starting positon relative to the fluid dispensing assembly 120.

In step 156, the wipe dispensing controller 109 applies a fluid to the portion 114 of the wipe supply 101 via the fluid dispensing assembly 120 based upon the wipe criterion 136 to generate the wipe 112. For example, as the wipe dispensing controller 109 advances the wipe material 116 via the drive assembly 115, the wipe dispensing controller 109 can activate the dispensing assembly 120 via operation signal 128 to apply solution to the wipe portion 114 in a predetermined manner or pattern. The wipe dispensing controller 109 drives the wet wipe 112 through the drive assembly 115 to a desired length, such as provided by the wipe criterion 136. From there, the wet wipe 112 can be severed from the wipe supply 101, if so equipped, and the user can remove it from the system 100 for use. Alternately, if pre-perforated wipe material 116 is used, the user can tear the wet wipe 112 at the perforations and remove it from the wipe supply 101. The system 100 is now ready to produce another wipe 112.

As provided above, the wipe dispensing system 100 is configured to produce customized disinfectant or cleaning wipes 112 on demand, such as at the point of use within a healthcare environment. Customization of the wipes 112 is controlled by the instructions provided by the end user or is based upon a preset cleaning or disinfecting criterion stored by the wipe dispensing controller 109. As such the wipe dispensing system 100 can generate multiple types of custom wipes 112 for a particular cleaning or disinfecting regimen. Additionally, by dispensing the wipes 112 as part of an on-demand process, the wipe dispensing system 100 mitigates end-users from handling the wipe supply 101, thereby mitigating contamination.

The wipe dispensing system 100 can include a number of alternate embodiments. For example, as provided in detail below, the placement as well as quantity of solution can be selected by the user. Multiple solution supplies 105 may be included to allow the user to select the type of disinfectant that is preferred for a particular application. Some embodiments can allow for the production of different sizes of wipes 112, and some may have two or more selectable wipe materials 116. The wipe dispensing controller 109 may be configured to provide the system 100 with increased capabilities, versatility, and network connectivity.

Figure 4:
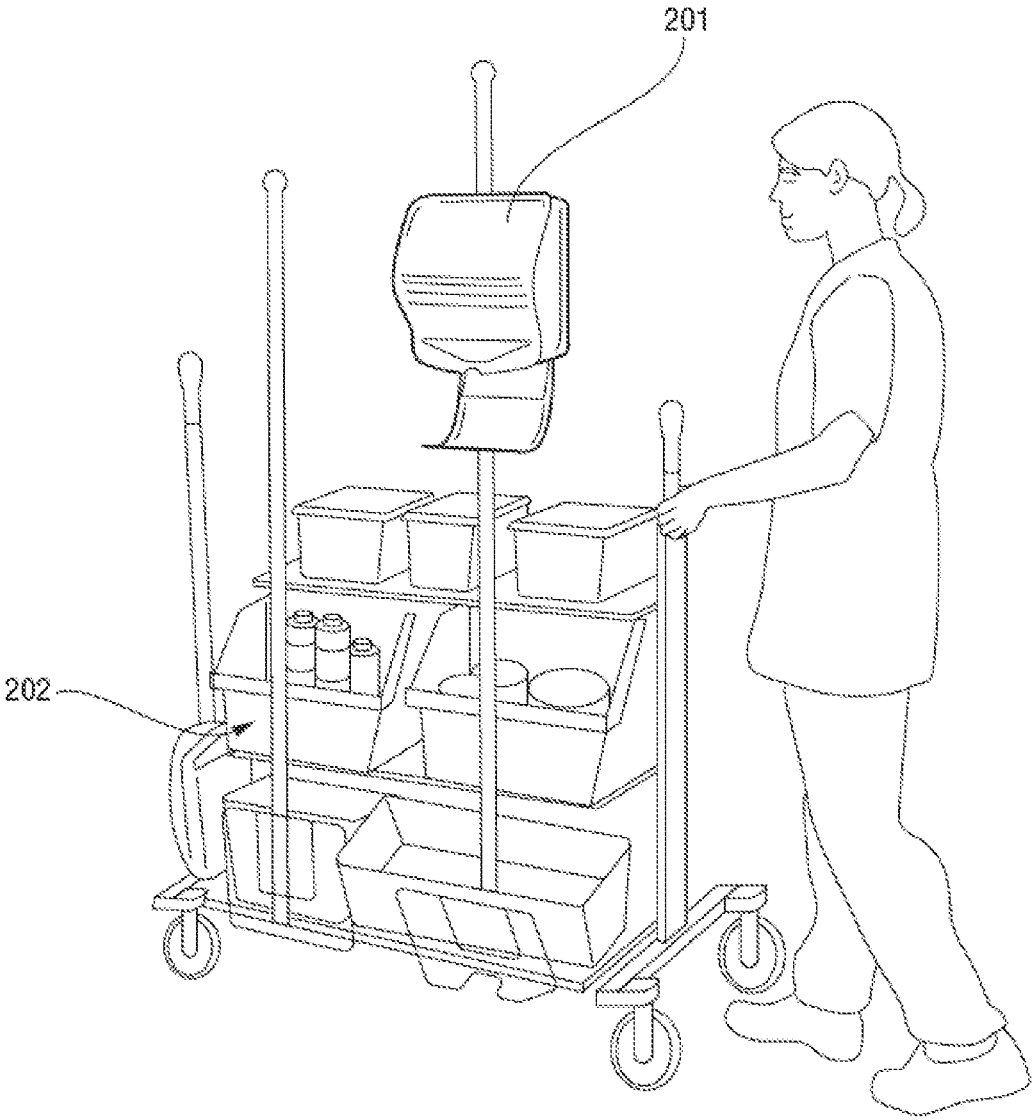
FIG. 4 illustrates the wipe dispensing system of FIG. 1 included as part of a portable unit, according to one embodiment.

As indicated above, the wipe dispensing system 100 can be portable, e.g., attached to a cleaning cart or other roll-around device. FIG. 4 shows an embodiment of the wipe dispensing system 100 attached as part of a hospital cleaning cart 202. This type of cart 202 may be particularly useful in a hospital environment to clean a patient room after a patient has been discharged, as it contains materials utilized to clean and disinfect a room. Inclusion of the wipe dispensing system 100 as part of the hospital's cleaning cart 202 can increase productivity and cleaning effectiveness, as well as decrease the number of cleaning products needed on the cart 202.

The wipe dispensing system 100 may also be mounted on a stand-alone cart that can be rolled to an appropriate location. Alternatively, the wipe dispensing system 100 may be permanently mounted to a wall or other surface in a convenient location.

As provided above, the wipe dispensing controller 109 is configured to receive a wipe criterion 136 which defines a characteristic of a wipe 112 to be provided by the wipe dispensing system 100. As described below, these characteristics can include length, material type, amount of solution, and/or type of solution associated with the wipe 112.

In one arrangement, and with reference to FIG. 2, the wipe criterion 136 can identify a wipe length associated with the portion 114 of the wipe supply 101. In response to receiving the wipe criteria 136, the wipe dispensing controller 109 can transmit the operation signal 124 the drive assembly 115 to cause the drive assembly 115 to advance the wipe supply 101 and the wipe portion 114 by the distance or wipe length identified by the wipe criterion 136. As such, the wipe dispensing system 100 can provide more control over the length of the wipes dispensed to the end user. Further, a severing mechanism can be included as part of the wipe dispensing system 100 and used with the continuous wipe supply 101 that has no perforations. In this manner, the wipe supply 101 can be driven to a desired distance, at which point the wipe 112 is severed from the supply 101. This allows the system 100 to dispense a wipe 112 of any length.

In one arrangement, the wipe criterion 136 can identify a wipe material type to be utilized for a cleaning or disinfecting procedure. As indicated in FIG. 2, in response to receiving the wipe criteria 136, the wipe dispensing controller 109 can transmit a signal 140 to the wipe supply 101 to select the wipe material 116 to be utilized with the drive assembly 115, as identified by the wipe criteria 136. Certain embodiments of the wipe dispensing system 100 can include a wipe supply device (not shown) which includes multiple wipe supplies 101. These supply devices have a provision for accepting two or more rolls of material, sheet feeders, or a combination of the two. These supply devices can utilize multiple drive assemblies or a single drive assembly 120 with the ability to select from a desired wipe supply 101. Having a choice of wipe materials 116 adds to the versatility of the wipe system 100.

For example, the drive assembly 115 may be loaded with wipe materials 116 of two different widths, allowing the production of larger and smaller wipes 112 depending on the application. This can make the wipe more convenient to use since it is sized for the application. It also conserves material when a smaller wipe 112 is sufficient. When used with a continuous wipe supply 101 and severing system as described above, there is even greater control over wipe size. Wipe supplies 101 of varying thickness or different wipe materials may be loaded into the device. Accordingly, based upon the wipe criteria 136, the wipe dispensing controller 109, can tailor a wipe 112 for a specific use.

In one arrangement, the wipe criterion 136 can identify a wipe temperature to be utilized for a cleaning or disinfecting procedure. In response to receiving the wipe criteria 136, the wipe dispensing controller 109 can transmit an operation signal 128 to the fluid dispensing assembly 120 to activate a heating element. For example, for some applications, the wipe dispensing system 100 can be configured to produce a heated wipe. Heat may be desirable for wipes 112 produced for human use, adding comfort for hand sanitizing, baby wipes or wound dressing, and may also aid in cleaning of surfaces. The ability to heat the solution prior to dispensing in order to produce a warm wipe can be included in the dispensing assembly 120. This can be accomplished by a heating element heating the entire supply reservoir 105, or by selectively heating solution either with an inline heating element or a heating element disposed in the dispenser head 107. Any suitable heating device, such as a resistance heater, may be utilized.

In one arrangement, the wipe dispensing controller 109 of the wipe dispensing system 100 can be configured to control the amount, or volume, of solution that is dispensed onto the portion 114 of the wipe supply 101. For example, the wipe criterion 136 can identify a fluid volume to be applied to the portion 114 of the wipe supply 101 by the fluid dispensing assembly 120. In response to receiving the wipe criteria 136, the wipe dispensing controller 109 can transmit operation signal 128 to the fluid dispensing assembly 120 to cause adjustment the volume of solution dispensed by the fluid dispensing assembly 120 in order to apply the identified fluid volume of the solution provided to the portion 114 of the wipe supply 101. Accordingly, wipes 112 can be produced that range from slightly damp to fully saturated and are selectable for a specific use.

In one arrangement, the wipe dispensing controller 109 of the wipe dispensing system 100 can be configured to control the location of placement of the solution onto the wipe portion 114. For example, the wipe criterion 136 can identify at least one fluid dispensing pattern to be provided by the fluid dispensing assembly 120. In response to receiving the wipe criteria 136, the wipe dispensing controller 109 can transmit operation signal 128 to the fluid dispensing assembly 120 to cause the fluid dispensing assembly 120 to apply the fluid to the portion 114 of the wipe supply 101 based upon the at least one fluid dispensing pattern. There are many ways that the fluid dispensing assembly 120 can apply different patterns to the wipe portion 114. For example, selective valving within the elongated bar 107, a series of selectable spray heads arrayed longitudinally across the device, an articulating arm with a dispenser on its end, or a digital thermal dispenser similar to an ink jet print head can be utilized by the fluid dispensing assembly 120 to provide different patterns. Further, the drive and dispensing functions may occur sequentially of simultaneously in order to obtain a desired dispense pattern.

With control over the quantity and placement of solution, the wipe dispensing system 100 can tailor the wipes 112 for a specific purpose and can conserve solution. Conventional pre-packaged wet wipes are typically saturated from edge to edge, meaning that the maximum amount of solution must be included within the wipes container. This leads to waste, since a fully saturated wipe 112 is not always necessary. With the system 100 of the current innovation, solution can be dispensed in the amount and location that is optimal for a specific application. For example, for heavy disinfecting use a wipe 112 may be fully saturated, while for a lighter cleaning application, solution may be misted onto the wipe or dispensed in a zigzag or other pattern that leaves dry sections between wet sections. For some applications, it may be an advantage to wet only half of the wipe portion 114, with one side used for cleaning and the other for drying.

In one arrangement, the fluid dispensing assembly 120 can include two or more reservoirs 105 containing different solutions. As such, the wipe dispensing controller 109 of the wipe dispensing system 100 can be configured to select the type of solution to be dispensed onto the wipe portion 114. For example, the wipe criterion 136 can identify at least one fluid or solution to be provided by the fluid dispensing assembly 120. In response to receiving the wipe criteria 136, the wipe dispensing controller 109 can transmit operation signal 128 to the fluid dispensing assembly 120 to cause the fluid dispensing assembly 120 to select the solution identified by the wipe criteria 136 and to dispense the selected solution to the portion 114 of the wipe supply 101.

The fluid dispensing assembly 120 can also allow for the use of multiple solutions. For example, the fluid dispensing assembly 120 may include two or more reservoirs 105 containing different solutions. Disinfecting solutions differ in their ability to remediate pathogens and in their compatibility with surfaces being cleaned. For example, quat compounds are good disinfectants and have some detergent action, but are generally ineffective against viruses, spores and Mycobacterium tuberculosis, but they are appropriate to use for disinfecting medical equipment that contacts intact skin (e.g., blood pressure cuffs). Sodium hypochlorite is effective against many pathogens but is a harsh chemical and can attack certain surfaces.

In one arrangement, the fluid dispensing assembly 120 is configured with multiple solutions available so that the system 100 can produce a wipe 112 that includes some combination of the multiple solutions for a specific application. There are numerous possible combinations. For example, the fluid dispensing assembly 120 can include an alcohol solution and produce hand wipes, or a detergent solution for cleaning heavy dirt. This fluid dispensing assembly 120 can also be used to mix two reactive chemicals that together form a solution. This is not possible with pre-packaged wipes.

In one arrangement, the wipe dispensing controller 109 is configured to receive location information 145 associated with the wipe 112 to be provided by the wipe dispensing system 100. The wipe dispensing controller 109 can, in turn, receive or identify the wipe criterion 136 associated with the location information 145 and can generate a particular type of wipe 112 based upon the location information 145. For example, each location within a facility, such as a health care facility, may require a distinct type of wipe for cleaning. In such a case, the wipe dispensing controller 109 can be configured with a database of various locations (not shown), such as within the healthcare facility, having associated wipe criterions 136 corresponding to those locations. When the wipe dispensing controller 109 receives location information 145 that identifies a location within the facility to be cleaned, the wipe dispensing controller 109 can review the database to identify the wipe criterion 136 associated with the location. As a result, the wipe dispensing controller 109 can transmit operation signals 124, 128 to the drive assembly 115 and fluid dispensing assembly 120, respectively, to create and dispense a wipe 112 for the particular location.

In one arrangement, the wipe dispensing system 100 can be used for applications other than health care surface disinfection. For example, solutions and materials can be chosen to produce wound dressings. Solutions such as hydrocolloids, hydrogels, alginates, collagens and other can be used to treat a variety of wounds. With the ability to selectively dispense, and selection of materials and sizes, a variety of dressings can be made. Other dispense and wipe applications such as baby wipes and hand sanitizing wipes can be provided by embodiments of the wipe dispensing system 100.

In one embodiment, the wipe dispensing system 100 is configured to provide communications and analytics of data collected by the wipe dispensing controller 109. For example, with reference to FIG. 2, usage statistics, supply levels, device status, and other information that is compiled by the wipe dispensing controller 109 can be transmitted to a Central Management system 306. In one arrangement, the Central Management system 306 is configured as a cloud-based system that collects all the information sent by the controller 301. This information is used for reporting, billing, maintenance, analytical and other functions, and can be communicated from the Central Management system 306 to other parties such as accounting, management, or field support. This communication can be accomplished via WiFi, cellular or other suitable technology.

As indicated above, the wipe dispensing system 100 may have other sensors 307. These can include location sensors (GPS, cellular signal, etc.), environmental sensors such as temperature and humidity, and user identification sensors such as facial recognition or RFID identification badges.

As provided above, the user interface 110 can provide a user with various user selection modes and can allow the user to generate a wipe criterion 136 creation of a custom wipe. Examples of the user selection modes are provided as follows.

In one example, the user interface 110 can be set to provide selection of a single type of wipe 112. This is useful in applications where only one type of wipe 112 is needed, or when the wipe dispensing system 100 is being used by workers of low skill levels. It does not allow the use of an incorrect wipe. The wipe criteria 136 are pre-set so that only one wipe 112 can be produced.

In one example, the user interface 110 can provide a user with a limited set of wipe choices. This mode can be used for targeted applications such as patient room cleaning. The user interface 110 may use descriptions, for example, "bed rail" or "toilet tank", or pictograms depicting the surface to be cleaned. The users can select the corresponding button or, in some embodiments, speak the phrase "bed rail", "toilet tank", etc. Based on the user's selection, the controller 109 employs predetermined wipe criteria 136 to produce the desired wipe 112.

In one example, the user interface 110 can provide a user with control over the selection of wipe material 116, as well as other characteristics of a wipe 112 to be provided by the wipe dispensing system 100, such as length, type of solution, wetness level, pattern, etc. This is for high level users capable of tailoring a wipe to a particular use. The wipe criteria can be selected directly by the user. This may also employ a combination of user-selected and controller determined criteria.

In one example, the user interface 110 can include cleaning protocols for specific applications and can guide the user through the cleaning process. For example, in the case of a patient discharge cleaning, the user interface 110 can be programmed with information regarding the contents of a room and the cleaning protocols for an entire discharge cleaning. The user interface 110 can guide the user with step by step instructions and provide the correct wipe for the corresponding part of the cleaning process. The programming can be for generic rooms, for example private, semi-private, shared bath or private bath. Alternately, it can contain maps and room information specific to a facility, i.e. a map of the entire floor, wing or hospital. When used in conjunction with a location means, the device can recognize its location and determine the correct procedure and/or type of wipe 112 to produce. Wipe criteria 136 for each type of wipe 112 can be pre-determined and selected by the user interface 110.

As provided above, the wipe dispensing controller 109 can be configured to monitor usage and consumption of wipe material 116 and solution during the production of wipes 112. For example, with reference to FIG. 2, the wipe dispensing controller 109 can collect wipe dispensing system operation information 155 from the wipe supply 101, the drive assembly 115, and/or the fluid dispensing assembly. The information 155 can relate to the amount of wipe material 116 carried by the wipe supply 101, the amount of solution carried by the reservoir 105, or other statistics, for example. This information can be transmitted to and used by the Central Management system 306 for the monitoring of wipe material and solution levels. As a result, the Central Management system 306 or the wipe dispensing controller 109 can output a dispensing system operation report 157 to alert the facility and/or service personnel when replenishment is necessary. The wipe dispensing controller 109 can also monitor inventory levels based upon the information 155 and automatically place orders 155 for replacement supplies. Additionally, the wipe dispensing controller 109 can generate reports 155 for use by accounting, quality control, and others.

FIG. 2 shows a schematic representation of the system's operation and production of wipes based on a wipe criterion 136. An input is received by the user interface 110. The input can be in the form of user-selected commands, pre-set criteria, location information or other method of initiating wipe production. Based on the input, the user interface 110 determines the wipe criteria 136 needed to produce a wipe.

This on-demand wipe dispensing system 100 is well suited to a pay-per-use business model. In this model, the customer pays for each wipe produced by the system. This system 100 has the ability to automatically track and bill the customer for the quantity of wipes that are used.

The wipe dispensing system 100 can also have the ability to compare actual vs. predicted usage of wipes 112, and in some embodiments, the amount of time spent for a particular cleaning procedure. In the patient discharge cleaning example, the wipe dispensing system 100 is configured with the cleaning protocol for the room being cleaned. It determines what is to be cleaned, which type of wipe 112 should be used for each item, and how many of each wipe should be used to assure cleanliness. If fewer wipes than predicted are used, it can be an indication that the room was not adequately cleaned. The use of more wipes than predicted can mean that wipes are being wasted, unnecessarily adding to cleaning costs. When time is also monitored, the system 100 can detect that not enough time was spent to adequately clean the room, or that too much time was used, indicating a lack of efficiency. All of this can be used to insure quality and minimize waste of both materials and time. Cleaning performance can be compared by staff member, team, floor, day and time or other factors to help to attain a high level of efficacy and efficiency.

In FIG. 1 the dispensing assembly 115 is shown in an upstream position from the drive assembly 120. This orientation is shown for example only. The form and location of the components will be determined by specific product designs. The system 100 may include a severing mechanism (not shown) to cut the wet wipe 112 at a desired length.

While various embodiments of the innovation have been particularly shown and described, it will be understood by those skilled in the art that various changes in form and details may be made therein without departing from the spirit and scope of the innovation as defined by the appended claims.

What is claimed is:

1. A wipe dispensing system, comprising:

a drive assembly;

a fluid dispensing assembly;

a user interface configured to generate a user-selected wipe criterion for a targeted application based upon a user-selectable characteristic of a wipe; and a wipe dispensing controller disposed in electrical communication with the drive assembly, the fluid dispensing assembly, and the user interface, the wipe dispensing controller configured to:

receive the user-selected wipe criterion from the user interface, the user-selected wipe criterion defining the user-selectable characteristic of the wipe to be provided by the wipe dispensing system, activate the drive assembly to position a wipe material relative to the fluid dispensing assembly based upon the user-selected wipe criterion, and activate the fluid dispensing assembly to apply a fluid to at least one portion of the wipe material based upon the user-selected wipe criterion;

wherein:

the user-selected wipe criterion identifies at least one fluid provided by the fluid dispensing assembly; and the wipe dispensing controller is configured to select the at least one fluid for the fluid dispensing assembly for application to the at least one portion of the wipe material via the fluid dispensing assembly.

2. The wipe dispensing system of claim 1, wherein:

the user-selected wipe criterion identifies the wipe material; and the wipe dispensing controller is configured to select the wipe material for the drive assembly based upon the user-selected wipe criterion.

3. The wipe dispensing system of claim 1, wherein:

the user-selected wipe criterion identifies at least one fluid dispensing pattern to be provided by the fluid dispensing assembly; and the wipe dispensing controller is configured to activate the fluid dispensing assembly to apply the fluid to the at least one portion of the wipe material via the fluid dispensing assembly based upon the at least one fluid dispensing pattern.

4. The wipe dispensing system of claim 1, wherein:

the user-selected wipe criterion identifies a wipe length associated with the wipe material; and the wipe dispensing controller is configured to activate the drive assembly to position a wipe material relative to the fluid dispensing assembly based upon the identified wipe length.

5. The wipe dispensing system of claim 1, wherein:

the user-selected wipe criterion identifies a fluid volume to be applied to the portion of the wipe material by the fluid dispensing assembly; and the wipe dispensing controller is configured to activate the fluid dispensing assembly to apply the identified fluid volume of the fluid to at least one portion of the wipe material based upon the user-selected wipe criterion.

6. The wipe dispensing system of claim 1, wherein the wipe dispensing controller is configured to:

receive location information associated with the wipe to be provided by the wipe dispensing system; and receive the user-selected wipe criterion from the user interface, the user-selected wipe criterion defining the user-selectable characteristic of the wipe to be provided by the wipe dispensing system at the location identified by the location information.

7. The wipe dispensing system of claim 1, wherein the wipe dispensing controller is further configured to:

collect wipe dispensing system operation information from at least one of the drive assembly and the fluid dispensing assembly; and output a dispensing system operation report based upon the wipe dispensing system operation information.

8. In a wipe dispensing controller, a method for dispensing a custom wipe from a wipe dispensing system, comprising:

receiving a user-selected wipe criterion from a user interface, the user interface configured to generate the user-selected wipe criterion for a targeted application based upon a user-selectable characteristic of a wipe, wherein receiving the user-selected wipe criterion comprises receiving the user-selected wipe criterion which identifies at least one fluid provided by the fluid dispensing assembly;

selecting the at least one fluid for the fluid dispensing assembly for application to the at least one portion of the wipe material via the fluid dispensing assembly;

activating the drive assembly to position a wipe material relative to the fluid dispensing assembly based upon the user-selected wipe criterion; and activating the fluid dispensing assembly to apply a fluid to at least a portion of the wipe material based upon the user-selected wipe criterion.

9. The method of claim 8, wherein:

receiving the user-selected wipe criterion comprises receiving the user-selected wipe criterion which identifies a wipe material; and selecting the wipe material for the drive assembly based upon the user-selected wipe criterion.

10. The method of claim 8, wherein:

receiving the user-selected wipe criterion comprises receiving the user-selected wipe criterion which identifies at least one fluid dispensing pattern to be provided by the fluid dispensing assembly; and activating the fluid dispensing assembly comprises activating the fluid dispensing assembly to apply the fluid to the at least one portion of the wipe material via the fluid dispensing assembly based upon the at least one fluid dispensing pattern.

11. The method of claim 8, wherein:

receiving the user-selected wipe criterion comprises receiving the user-selected wipe criterion which identifies a wipe length associated with the wipe material; and activating the drive assembly comprises activating the drive assembly to position the wipe material relative to the fluid dispensing assembly based upon the identified wipe length.

12. The method of claim 8, wherein:

receiving the user-selected wipe criterion comprises receiving the user-selected wipe criterion which identifies a fluid volume to be applied to the portion of the wipe material by the fluid dispensing assembly; and activating the fluid dispensing assembly comprises activating the fluid dispensing assembly to apply the identified fluid volume of the fluid to at least one portion of the wipe material based upon the user-selected wipe criterion.

13. The method of claim 8, further comprising:

receiving location information associated with the wipe to be provided by the wipe dispensing system; and receiving the user-selected wipe criterion from the user interface comprises receiving the user-selected wipe criterion from the user interface based upon the location information, the wipe criterion defining the user-selectable characteristic of the wipe to be provided by the wipe dispensing system at the location identified by the location information.

14. The method of claim 8, further comprising:

collecting wipe dispensing system operation information from at least one of the drive assembly and the fluid dispensing assembly; and outputting a dispensing system operation report based upon the wipe dispensing system operation information.

15. A wipe dispensing controller having a processor and a memory, the wipe dispensing controller configured to:

receive a user-selected wipe criterion from a user interface, the user interface configured to generate the user-selected wipe criterion for a targeted application based upon a user-selectable characteristic of a wipe, the user-selected wipe criterion identifying at least one fluid provided by the fluid dispensing assembly;

select the at least one fluid for the fluid dispensing assembly for application to the at least one portion of the wipe material via the fluid dispensing assembly;

activate the drive assembly to position a wipe material relative to the fluid dispensing assembly based upon the user-selected wipe criterion; and activate the fluid dispensing assembly to apply a fluid to at least a portion of the wipe material based upon the user-selected wipe criterion.

16. A wipe dispensing system, comprising:

a drive assembly;

a fluid dispensing assembly;

a user interface configured to generate a user-selected wipe criterion for a targeted application based upon a user-selectable characteristic of a wipe; and a wipe dispensing controller disposed in electrical communication with the drive assembly, the fluid dispensing assembly, and the user interface, the wipe dispensing controller configured to:

receive the user-selected wipe criterion from the user interface, the user-selected wipe criterion defining the user-selectable characteristic of the wipe to be provided by the wipe dispensing system, activate the drive assembly to position a wipe material relative to the fluid dispensing assembly based upon the user-selected wipe criterion, and activate the fluid dispensing assembly to apply a fluid to at least one portion of the wipe material based upon the user-selected wipe criterion;

wherein:

the user-selected wipe criterion identifies at least one fluid dispensing pattern to be provided by the fluid dispensing assembly; and the wipe dispensing controller is configured to activate the fluid dispensing assembly to apply the fluid to the at least one portion of the wipe material via the fluid dispensing assembly based upon the at least one fluid dispensing pattern.

17. A wipe dispensing system, comprising:

a drive assembly;

a fluid dispensing assembly;

a user interface configured to generate a user-selected wipe criterion for a targeted application based upon a user-selectable characteristic of a wipe; and a wipe dispensing controller disposed in electrical communication with the drive assembly, the fluid dispensing assembly, and the user interface, the wipe dispensing controller configured to:

receive the user-selected wipe criterion from the user interface, the user-selected wipe criterion defining the user-selectable characteristic of the wipe to be provided by the wipe dispensing system, activate the drive assembly to position a wipe material relative to the fluid dispensing assembly based upon the user-selected wipe criterion, and activate the fluid dispensing assembly to apply a fluid to at least one portion of the wipe material based upon the user-selected wipe criterion;

wherein:

the user-selected wipe criterion identifies a fluid volume to be applied to the portion of the wipe material by the fluid dispensing assembly; and the wipe dispensing controller is configured to activate the fluid dispensing assembly to apply the identified fluid volume of the fluid to at least one portion of the wipe material based upon the user-selected wipe criterion.

18. In a wipe dispensing controller, a method for dispensing a custom wipe from a wipe dispensing system, comprising:

receiving a user-selected wipe criterion from a user interface, the user interface configured to generate the user-selected wipe criterion for a targeted application based upon a user-selectable characteristic of a wipe and the user-selected wipe criterion identifying at least one fluid dispensing pattern to be provided by the fluid dispensing assembly;

activating the drive assembly to position a wipe material relative to the fluid dispensing assembly based upon the user-selected wipe criterion; and activating the fluid dispensing assembly to apply a fluid to at least a portion of the wipe material based upon the at least one fluid dispensing pattern.

19. In a wipe dispensing controller, a method for dispensing a custom wipe from a wipe dispensing system, comprising:

receiving a user-selected wipe criterion from a user interface, the user interface configured to generate the user-selected wipe criterion for a targeted application based upon a user-selectable characteristic of a wipe and the user-selected wipe criterion identifying a fluid volume to be applied to the portion of the wipe material by the fluid dispensing assembly;

activating the drive assembly to position a wipe material relative to the fluid dispensing assembly based upon the user-selected wipe criterion; and activating the fluid dispensing assembly to apply the identified fluid volume of the fluid to at least one portion of the wipe material based upon the user-selected wipe criterion.

* * * * *